US008881435B2

(12) United States Patent
Harrington et al.

(10) Patent No.: US 8,881,435 B2
(45) Date of Patent: Nov. 11, 2014

(54) IRON WITH DETACHABLE SOLEPLATE

(75) Inventors: John Harrington, Deerfield Beach, FL (US); Daniel Sumser, Lake Worth, FL (US)

(73) Assignee: Sunbeam Products, Inc., Boca Raton, FL (US)

( * ) Notice: Subject to any disclaimer, the term of this patent is extended or adjusted under 35 U.S.C. 154(b) by 735 days.

(21) Appl. No.: 13/192,083

(22) Filed: Jul. 27, 2011

(65) Prior Publication Data

US 2012/0024015 A1 Feb. 2, 2012

Related U.S. Application Data

(60) Provisional application No. 61/369,185, filed on Jul. 30, 2010.

(51) Int. Cl.

| | |
|---|---|
| ***D06F 75/38*** | (2006.01) |
| ***D06F 75/20*** | (2006.01) |
| ***D06F 75/24*** | (2006.01) |
| *D06F 75/18* | (2006.01) |

(52) U.S. Cl.

CPC ..... *D06F 75/38* (2013.01); *D06F 75/20* (2013.01); *D06F 75/24* (2013.01)

USPC ..... 38/81; 38/93

(58) Field of Classification Search

CPC ..... D06F 75/30; D06F 75/32; D06F 75/38; H05B 3/0071; H05B 3/009

USPC ..... 38/80, 81, 93, 77.83; 219/443.1; 126/271.1; 312/236

See application file for complete search history.

(56) References Cited

U.S. PATENT DOCUMENTS

| | | | | |
|---|---|---|---|---|
| 2,305,672 | A * | 12/1942 | Etienne | 219/392 |
| 2,408,209 | A * | 9/1946 | Gould | 38/82 |
| 2,451,984 | A * | 10/1948 | Shapiro | 69/20 |
| 3,602,691 | A * | 8/1971 | Frazier | 219/387 |
| 5,307,573 | A * | 5/1994 | Watkins | 38/77.8 |
| 7,716,858 | B2 * | 5/2010 | Lee | 38/93 |
| 2001/0030183 | A1 * | 10/2001 | Bowen | 219/246 |

* cited by examiner

*Primary Examiner* — Ismael Izaguirre
(74) *Attorney, Agent, or Firm* — Michael J. Corrigan

(57) ABSTRACT

A hand-held convertible iron is provided that includes a housing, a soleplate disposed on the housing for pressing a garment, the soleplate having a first portion and a second portion, a heating means having a first element and a second element, the first element being disposed adjacent to the first portion of the soleplate and the second element being disposed adjacent to the second portion, wherein the second portion of the soleplate is removably attached to the housing. A quick-disconnect electrical connection provides electrical power to the second element of the heating means when the second portion of the soleplate is attached to the housing.

24 Claims, 2 Drawing Sheets

IRON WITH DETACHABLE SOLEPLATE

This is a non-provisional patent application which claims the benefit of priority to U.S. provisional patent application no. 61/369,185 filed on Jul. 30, 2010.

FIELD OF THE INVENTION

The invention relates to an iron, and more particularly to, an improved iron that has a two-part soleplate in which a rear portion is detachable.

BACKGROUND OF THE INVENTION

There is a great need for portable, efficient devices to steam and iron garments. It is well-known to use a steaming iron when ironing clothes and other garments. Non-iron devices called "steamers" have also been used to remove wrinkles and creases from clothes on a hanger or hanging from a rack by jetting steam to the clothes. These steamers do not have an ironing function because they lack the hot pressing plate found on irons. Both steam irons and steamers have been used for applying steam to remove creases and crinkles from hanging garments and other cloth materials. Steam has also been used in the cleaning of a variety of objects such as curtains, couches, furniture covers (e.g., couch covers), etc.

While steamers and steaming irons have been useful steam devices, neither device by itself is versatile enough for various applications which require the use of both devices. For example, a steaming iron can be heavy and bulky to use when steaming curtains and other hanging objects such as a wrinkled suit jacket. The steamer is generally lighter and easier to manipulate for steaming, hanging clothing, and other cloth objects. However, while a steamer may be useful to steam a hanging garment such as a suit jacket, the steamer can not be used to iron out a persistent wrinkle in the hanging garment since the steamer lacks the hot pressing plate found on irons.

Accordingly, there is a need for a device that can both iron and steam garments in a conventional manner on an ironing board and also iron and steam hanging garments where a pressing plate is needed for ironing out wrinkles in the hanging garment and the device is still not too heavy or bulky for steaming the hanging garment.

SUMMARY OF THE INVENTION

In an embodiment, there is provided a convertible appliance, including a housing, a first soleplate portion including a first heating element permanently attached to the housing, and a second soleplate portion including a second heating element removably attached to the housing disposed adjacent to the first soleplate portion. In a first configuration the second soleplate portion is attached to the housing, and alternately, in a second configuration the second soleplate portion is removed from the housing.

In an embodiment, there is provided a method of treating a garment, including providing a housing, providing a first soleplate portion including a first heating element permanently attached to the housing, providing a second soleplate portion including a second heating element configured to removably attach to the housing disposed adjacent to the first soleplate portion, and attaching in a first configuration the second soleplate portion to the housing.

BRIEF DESCRIPTION OF THE DRAWINGS

A more complete understanding of the present invention, and the attendant advantages and features thereof, will be more readily understood by reference to the following detailed description when considered in conjunction with the accompanying drawings wherein.

DETAILED DESCRIPTION OF THE INVENTION

A convertible pressing/steaming device that can be converted from a first configuration for conventional pressing/steaming to a second configuration for non-conventional pressing/steaming of hanging garments and fabrics as described below.

Figure 1:
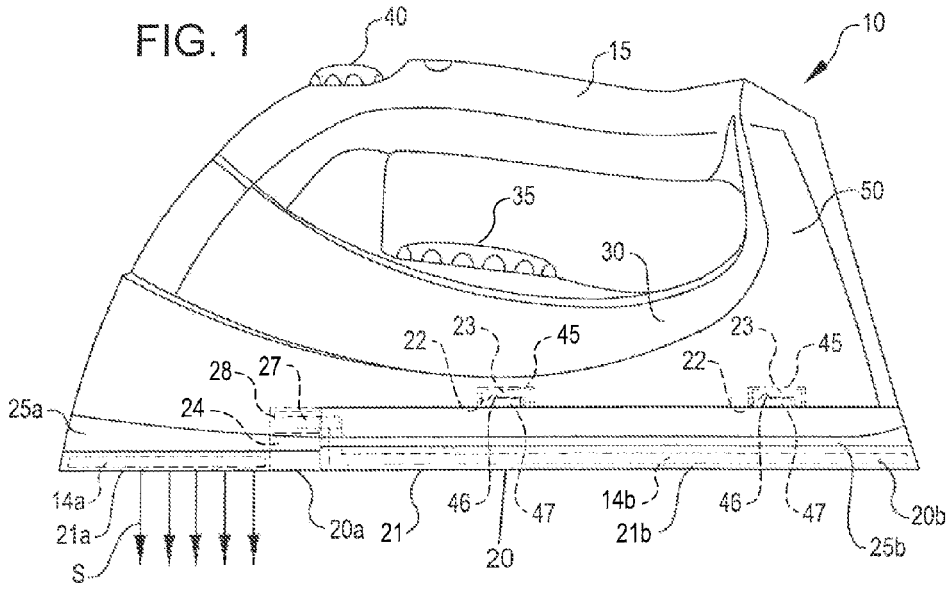
FIG. 1 is a side view of an iron in a first configuration, according to an exemplary embodiment of the invention.

Referring now to the awing figures in which like reference designators refer to like elements, there is shown in FIG. 1 a convertible iron 10 in a first or fully assembled configuration. The iron 10 includes a two-part soleplate 20 made of for example, a metal material including a heating means (shown in phantom) mounted in a good heat conducting relationship therewith. The soleplate 20 is comprised of a first soleplate portion 20*a* having a pressing surface 21*a* disposed towards a front portion of the iron 10 and a second soleplate portion 20*b* having a pressing surface 21*b* disposed towards the rear of the iron 10.

The heating means is comprised of a first heating element 14*a* mounted in a good heat conducting relationship with the first soleplate portion 20*a*. The heating means is further comprised of a second heating element 14*b* mounted in a good heat conducting relationship with the first soleplate portion 20*a*. In the first configuration, the heating elements 14*a* and 14*b* heat the entire soleplate 20 for providing maximum heated surface area of the pressing surface 21 for ironing the fabric being ironed.

A skirt 25 (comprised of skirt portions 25*a* and 25*b*) is mounted on the soleplate 20, followed by a water tank (not shown) mounted on top of the skirt 25 and secured to the skirt 25 and the soleplate 20 by the use of for example, screws, flanges, or any other conventional means for fastening. A water tank cover (not shown) is interposed between the skirt 25 and the water tank (not shown). The water tank (not shown) is disposed in a housing 50, for example, in surrounding relation to the aforementioned elements. The housing 50 may be made from plastic or any other suitable material. A similar iron having the foregoing water tank disposed in a housing is illustrated and described in U.S. Pat. No. 6,321,472, owned by a common assignee, and incorporated by reference herein in its entirety.

Figure 4:
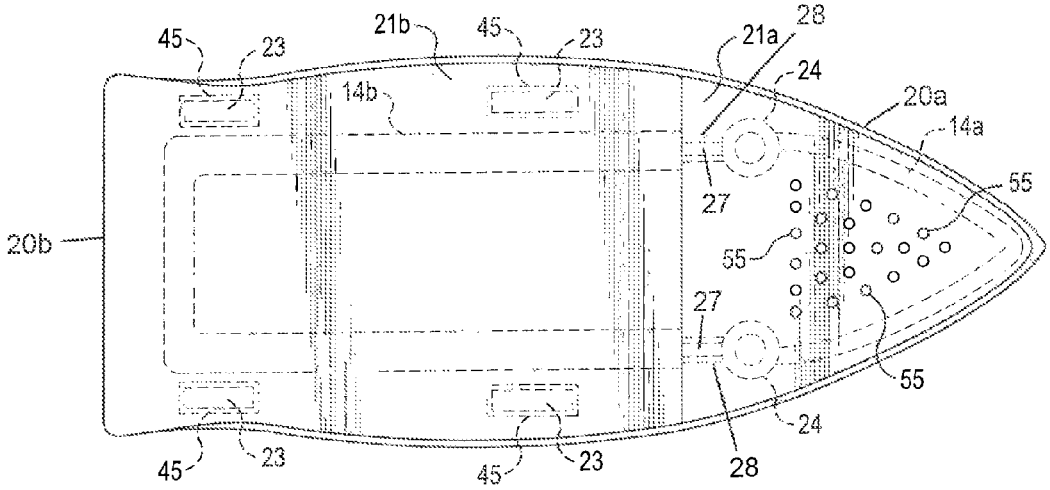
FIG. 4 is a bottom plan view of the iron of FIG. 1.

The water tank (not shown) includes a cavity (not shown) which may be filled with an aqueous solution such as water. A temperature dial 35 is disposed, for example, beneath a handle 15 formed in an upper portion of the housing 50 and a steam pushbutton 40 is fit, for example, on an upper portion of the housing 50, near the handle portion 15. Water contained in the tank (not shown) may be delivered to the soleplate 20, for example, in response to activation of the steam pushbutton 40 disposed in the handle 15, where it is emitted as steam S from openings 55 (FIG. 4) in the front portion 20*a* of the soleplate 20 in a well-known manner.

A power cord (not shown) may be operatively connected to the housing 50 to provide power to the iron 10, and in particular to the heating elements 14*a* and 14*b* for heating the soleplate 20 and generating the steam S from water supplied from the water tank (not shown). The temperature dial 35 is used to regulate the amount of electrical power provided from the power cord (not shown) to the first and second heating elements 14*a* and 14*b*. The power cord may be provided with a conventional plug which may be connected to a conventional source of ac power.

Figure 2:
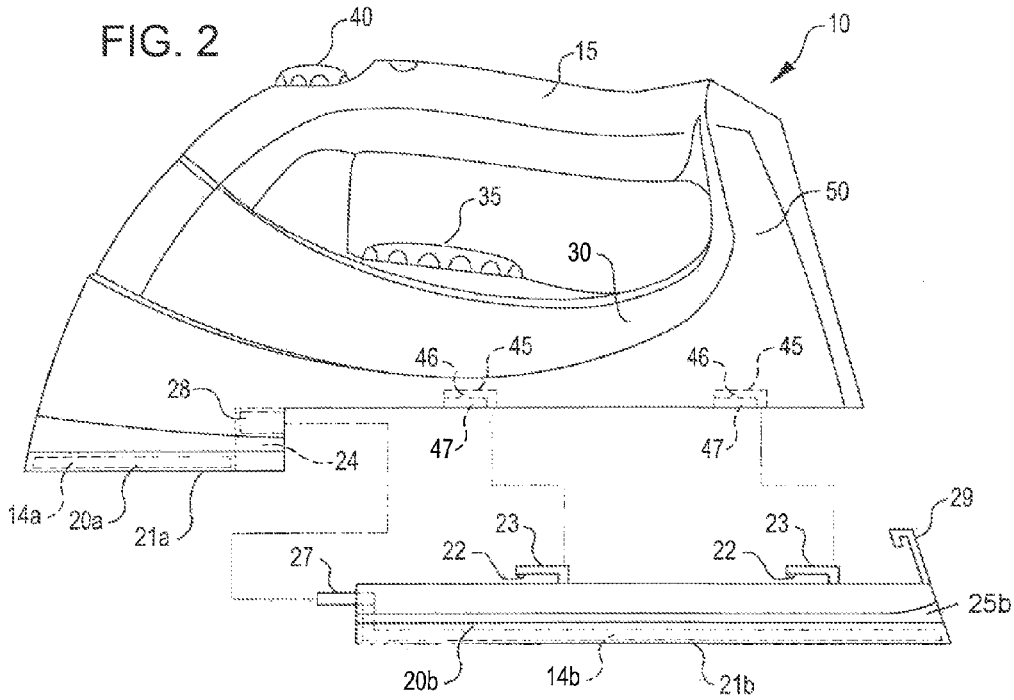
FIG. 2 is a side view of the iron of FIG. 1 in a second configuration.

Referring now to FIG. 2, there is shown the iron 10 in a second or detached configuration. In the second configuration, a rear portion 20*b* of the soleplate 20 and a rear portion 25*b* of the skirt 25 detaches from the housing 50 leaving a front portion 20*a* of the soleplate 20 available for pressing and steaming fabric. The detachment of the rear portion 20*b* of the soleplate 20 and the rear portion 25*b* of the skirt 25 from the housing 50 significantly reduces the weight of iron 10 enabling the iron 10 to be used in both a horizontal and vertical orientation for pressing and steaming fabric.

For example, upon activation of the steam pushbutton 40 disposed in the handle 15, steam S emitted from openings 55 (FIG. 4) in the front portion 20*a* of the soleplate 20 can be directed vertically downward while pressing or steaming fabric on a garment placed on an ironing board. Alternately, for example, upon activation of the steam pushbutton 40 disposed in the handle 15, steam S emitted from the openings 55 (FIG. 4) in the front portion 20*a* the soleplate 20 can be directed horizontally while pressing or steaming fabric on a hanging garment.

The rear portion 20*b* of the soleplate 20 may include, for example, quick-disconnect electrical connectors 27 that connect electrical power to the second heating element 14*b* when the rear portion 20*b* of the soleplate 20 is attached to the housing 50. The first heating element 14*a* remains intact disposed adjacent to the front portion 20*a* of the soleplate 20 for heating the front portion 20*a* in both the first and second configurations. The electrical connectors 27 also allow electrical power provided to the second heating element 14*b* to be easily disconnected when the rear portion 20*b* of the soleplate 20 is detached from housing 50. For example, each electrical connector 27 may be a male prong that fits into a complementary female socket 28 disposed on the housing 50. However, the foregoing electrical connector 27 is not meant to be limiting in that any suitable quick-disconnect electrical connector may be used known to one of ordinary skill in the art. In an exemplary embodiment, the number of electrical connectors 27 is two but this is not meant to be limiting.

In an embodiment, the socket 28 may be formed in a post 24 (see also FIG. 4) where electrical power selectively controlled from the temperature dial 35 is provided to the first heating element 14*a* and the second heating element 14*b*. The post 24 may be made of any electrically conductive material as is known to one of ordinary skill in the art. For example, the post 24 may be made of copper, brass or aluminum. In an exemplary embodiment, the number of posts 24 is two hut this is not meant to be limiting.

Figure 3:
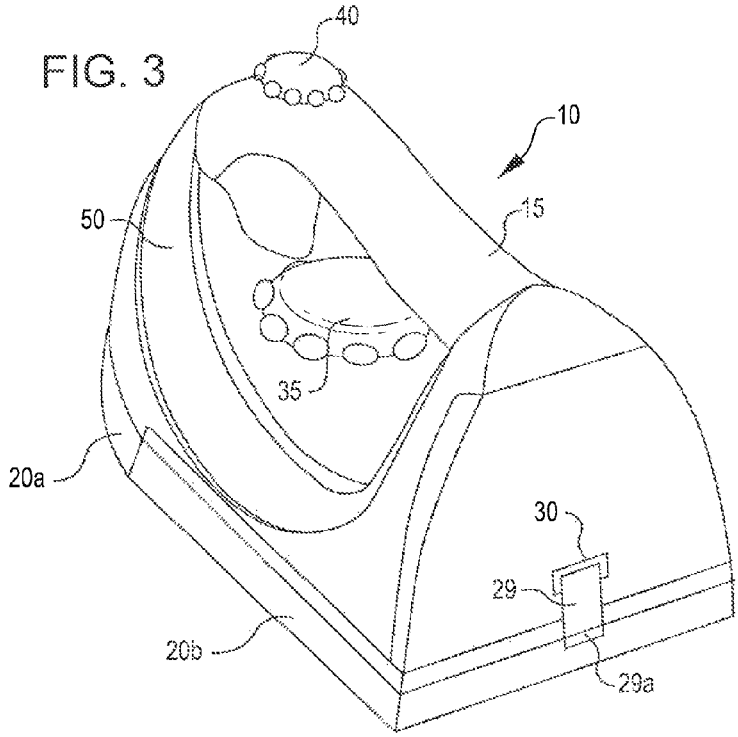
FIG. 3 is a rear perspective view of the iron of FIGS. 1-2.

The rear portion 20*b* of the soleplate 20 and the rear portion 25*b* of the skirt 25 may be secured to the housing 50 using any suitable fastening means such as latches, a catch, lock, interference type fit, etc., which allow these elements to be quickly detached and re-attached as desired. For example, in the embodiment shown in FIGS. 1-2, the fastening means may be prongs or fingers 23 that are inserted into recesses 45 in the bottom of the housing 50 that slidingly engage a lip 47 in the recess 45. A detent 22 on one end of the prong 23 may engage a nib 46 on the lip 47 for securing the prong 23 in the recess 45. A latch 29 may be provided at the rear of the detachable soleplate 20*b* for locking the soleplate 20*h* to the housing 50 (best seen, in FIGS. 2 and 3). The latch 29 engages a slot 30 on the rear face of the housing 50 and is released by depressing a tab 29*a*. When the tab 29*a* is depressed, the soleplate 20*b* may be grasped and pulled away from the body 50 thereby pulling the detents 22 over the nibs 46 and releasing the prongs 23 from the recesses 45.

All references cited herein are expressly incorporated by reference in their entirety.

It will be appreciated by persons skilled in the art that the present invention is not limited to what has been particularly shown and described herein above. In addition, unless mention was made above to the contrary, it should be noted that all of the accompanying drawings are not to scale. A variety of modifications and variations are possible in light of the above teachings without departing from the scope and spirit of the invention, which is limited only by the following claims.

What is claimed is:

1. A convertible appliance, comprising:

a housing;

a first soleplate portion including a first heating element permanently attached to the housing and a plurality of steam holes formed in only the first soleplate portion; and a second soleplate portion including a second heating element removably attached to the housing disposed adjacent to the first soleplate portion;

wherein in a first configuration the second soleplate portion is attached to the housing, and alternately, in a second configuration the second soleplate portion is removed from the housing.

2. The appliance of claim 1, wherein the first and second soleplate portions each include a pressing surface for pressing a garment positioned adjacent thereto disposed on an ironing surface, and when in the first configuration, the second soleplate portion is attached to the housing and both the first and second soleplate portions are used to press the garment.

3. The appliance of claim 2, wherein the plurality of steam holes formed in the first soleplate portion are configured to direct steam vertically from a bottom surface of the first soleplate portion towards a garment positioned adjacent thereto, said steam for removing wrinkles from the garment while the garment is being pressed.

4. The appliance of claim 1, wherein in the second configuration the second soleplate portion is configured to be removed to steam garments with the first soleplate portion only while pressing a garment.

5. The appliance of claim 4, wherein the plurality of steam holes formed in the first soleplate portion are configured to direct steam horizontally from a bottom surface of the first soleplate portion towards the garment positioned adjacent thereto, said steam for removing wrinkles from the garment.

6. The appliance of claim 5, wherein the garment to be steamed is hung vertically so that the first soleplate portion may be positioned adjacent to the garment for removing wrinkles from the garment.

7. The appliance of claim 1, further including a fastening means configured to secure the second soleplate portion to the housing in the first configuration.

8. The appliance of claim 7, wherein the fastening means includes prongs that are inserted into recesses in a bottom of the housing and that slidingly engage the recesses.

9. The appliance of claim 8, wherein the fastening means includes at least one of a catch, lock, or interference-type fit.

10. The appliance of claim 1, further including a latch at a rear end of the second soleplate portion for engaging a slot at a rear face of the housing configured to lock the soleplate to the housing.

11. The appliance of claim 10, further including a tab on the latch which may be depressed to release the second soleplate portion from the housing.

12. The appliance of claim 1, wherein the second soleplate portion further includes at least one quick-disconnect electrical connector at a rear of the second soleplate portion that connects electrical power from the housing to the second soleplate portion when the second soleplate portion is attached to the housing.

13. The appliance of claim 12, wherein the at least one electrical connector includes a male prong that is fitted into a female socket formed in the housing.

14. The appliance of claim 13, wherein the female socket is formed in a post disposed in the housing and the post is electrically connected to a temperature dial disposed on the housing to selectively provide electrical power to the second heating element disposed in the second soleplate.

15. The appliance of claim 14, wherein the post is made of an electrically conductive material.

16. The appliance of claim 15, wherein the post is made of copper.

17. The appliance of claim 14, wherein the number of electrical connectors is two and the number of posts having sockets that the prongs of the electrical connectors are fitted into is two.

18. The appliance of claim 1, where the appliance is an iron.

19. A convertible appliance, comprising:

a housing;

a first soleplate portion including a first heating element permanently attached to the housing;

a second soleplate portion including a second heating element removably attached to the housing disposed adjacent to the first soleplate portion, wherein the second soleplate portion further includes at least one quick-disconnect electrical connector that connects electrical power from the housing to the second soleplate portion when the second soleplate portion is attached to the housing;

the at least one electrical connector includes a male prong that is fitted into a female socket formed in the housing;

the female socket is formed in a post disposed in the housing and the post is electrically connected to a temperature dial disposed on the housing to selectively provide electrical power to the second heating element disposed in the second soleplate;

wherein in a first configuration the second soleplate portion is attached to the housing, and alternately, in a second configuration the second soleplate portion is removed from the housing.

20. The appliance of claim 19, wherein the first heating element is electrically connected to the post and the temperature dial disposed on the housing is used to selectively provide power to the first heating element disposed in the first soleplate.

21. The appliance of claim 19, wherein the post is made of an electrically conductive material.

22. The appliance of claim 19, wherein the post is made of copper.

23. The appliance of claim 19, wherein the number of electrical connectors is two and the number of posts having sockets that the prongs of the electrical connectors are fitted into is two.

24. The appliance of claim 14, wherein the first heating element is electrically connected to the post and the temperature dial disposed on the housing is used to selectively provide power to the first heating element disposed in the first soleplate.

* * * * *